United States Patent [19]

Brunner et al.

[11] 4,323,970

[45] Apr. 6, 1982

[54] METHOD AND CIRCUIT ARRANGEMENT FOR GENERATING SETTING SIGNALS FOR SIGNAL GENERATORS OF A TRAFFIC SIGNAL SYSTEM, PARTICULARLY A STREET TRAFFIC SIGNAL SYSTEM

[75] Inventors: Heinrich Brunner, Rottach; Karin Fischer, Munich, both of Fed. Rep. of Germany

[73] Assignee: Siemens Aktiengesellschaft, Berlin & Munich, Fed. Rep. of Germany

[21] Appl. No.: 155,291

[22] Filed: Jun. 2, 1980

[30] Foreign Application Priority Data

Jun. 22, 1979 [DE] Fed. Rep. of Germany ..... 2925333
Sep. 24, 1979 [DE] Fed. Rep. of Germany ..... 2938528

[51] Int. Cl.[3] ..... G08G 1/07

[52] U.S. Cl. ..... 364/436; 340/40; 340/41 R

[58] Field of Search ..... 364/436; 340/37, 40, 340/41 R, 43

[56] References Cited

U.S. PATENT DOCUMENTS 3,885,227 5/1975 Moissl ..... 340/41 R
3,916,374 10/1975 Drebinger et al. ..... 340/40
3,967,245 6/1976 Muramatu et al. ..... 340/40
4,215,405 7/1980 Brunner et al. ..... 364/436

*Primary Examiner*—Mark E. Nusbaum

*Assistant Examiner*—Gary Chin

*Attorney, Agent, or Firm*—Hill, Van Santen, Steadman, Chiara & Simpson

[57] ABSTRACT

A method and a circuit arrangement for generating setting signals for signal generators of a traffic signal system, particularly of a street traffic signal system, upon employment of indications of time intervals between mutually hostile traffic flows contained in a time interval matrix are discussed. The time intervals are read from the time interval matrix for each entry signal group and subtracted from the greatest time interval value which greatest time interval value is reduced in value in cyclical succession. When this value is reduced to zero or, respectively, when a zero difference is determined in the course of the difference formations, then appropriate setting signals for the signal generators of the traffic signal system are emitted. In another embodiment provides that the time intervals of entry signal groups selected as being non-determinant for influencing a change of signal are first retained unchanged by a separate marking and are only made effective for reduction of their value in that case in which the non-marked entry time intervals of the entry signal groups hostile to the same clearing signal groups have elapsed. These techniques effect a controlled stoppage and initiation of traffic flow in accordance with specific intersection plans in a simple and precise manner.

9 Claims, 6 Drawing Figures

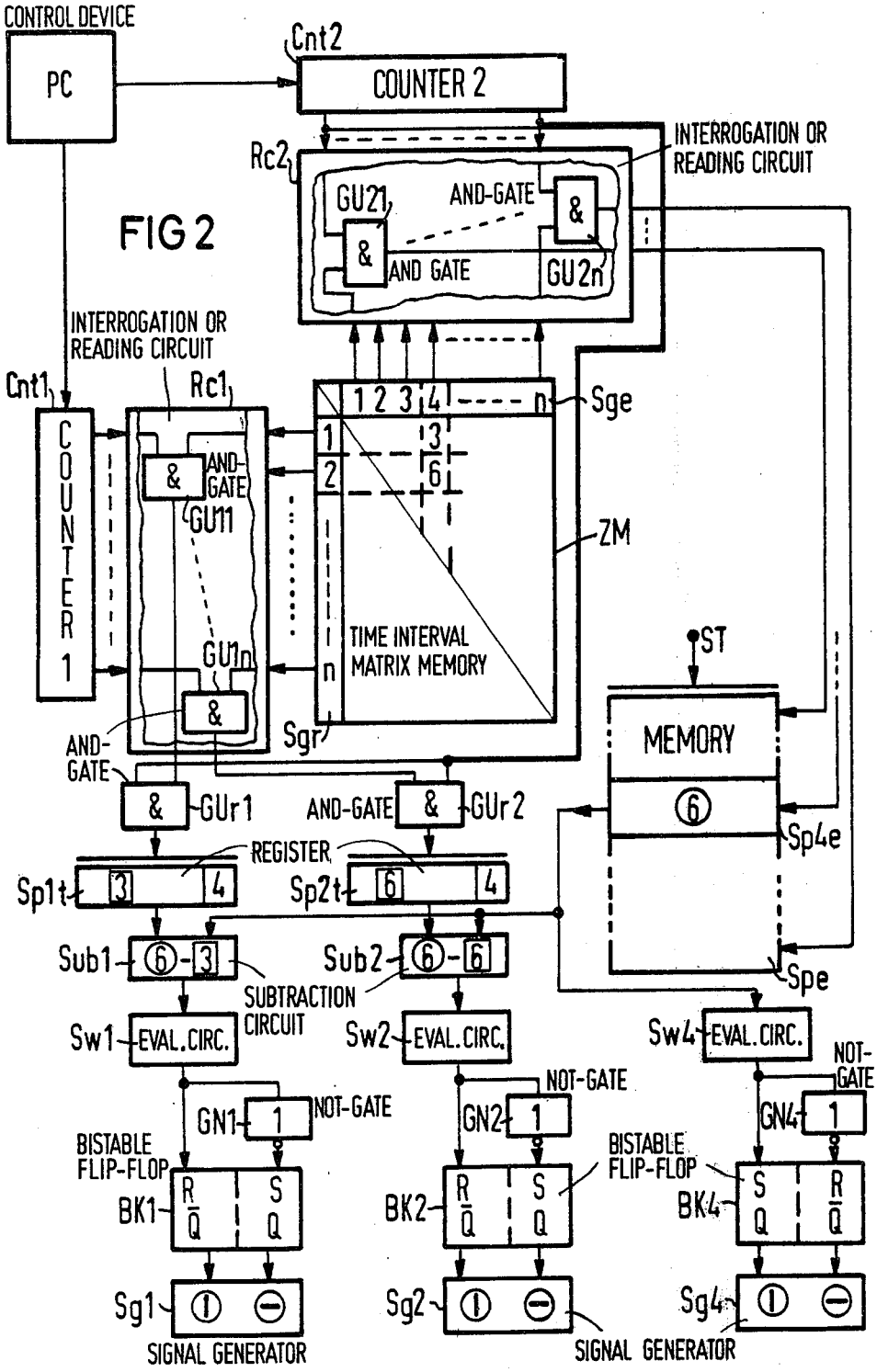
CONTROL DEVICE
PC
Cnt2
COUNTER 2
Rc2
INTERROGATION OR READING CIRCUIT
GU21
AND-GATE
AND GATE
GU2n
FIG 2
INTERROGATION OR READING CIRCUIT
Cnt1
Rc1
COUNTER 1
AND-GATE
GU11
GU1n
Sge
ZM
TIME INTERVAL MATRIX MEMORY
Sgr
ST
MEMORY
Sp4e
Spe
AND-GATE
GUr1
AND-GATE
GUr2
REGISTER
Sp1t
Sp2t
Sub1
Sub2
SUBTRACTION CIRCUIT
Sw1
EVAL.CIRC.
Sw2
EVAL.CIRC.
Sw4
EVAL.CIRC.
NOT-GATE
GN1
GN2
GN4
BISTABLE FLIP-FLOP
BK1
BK2
BK4
Sg1
Sg2
Sg4
SIGNAL GENERATOR

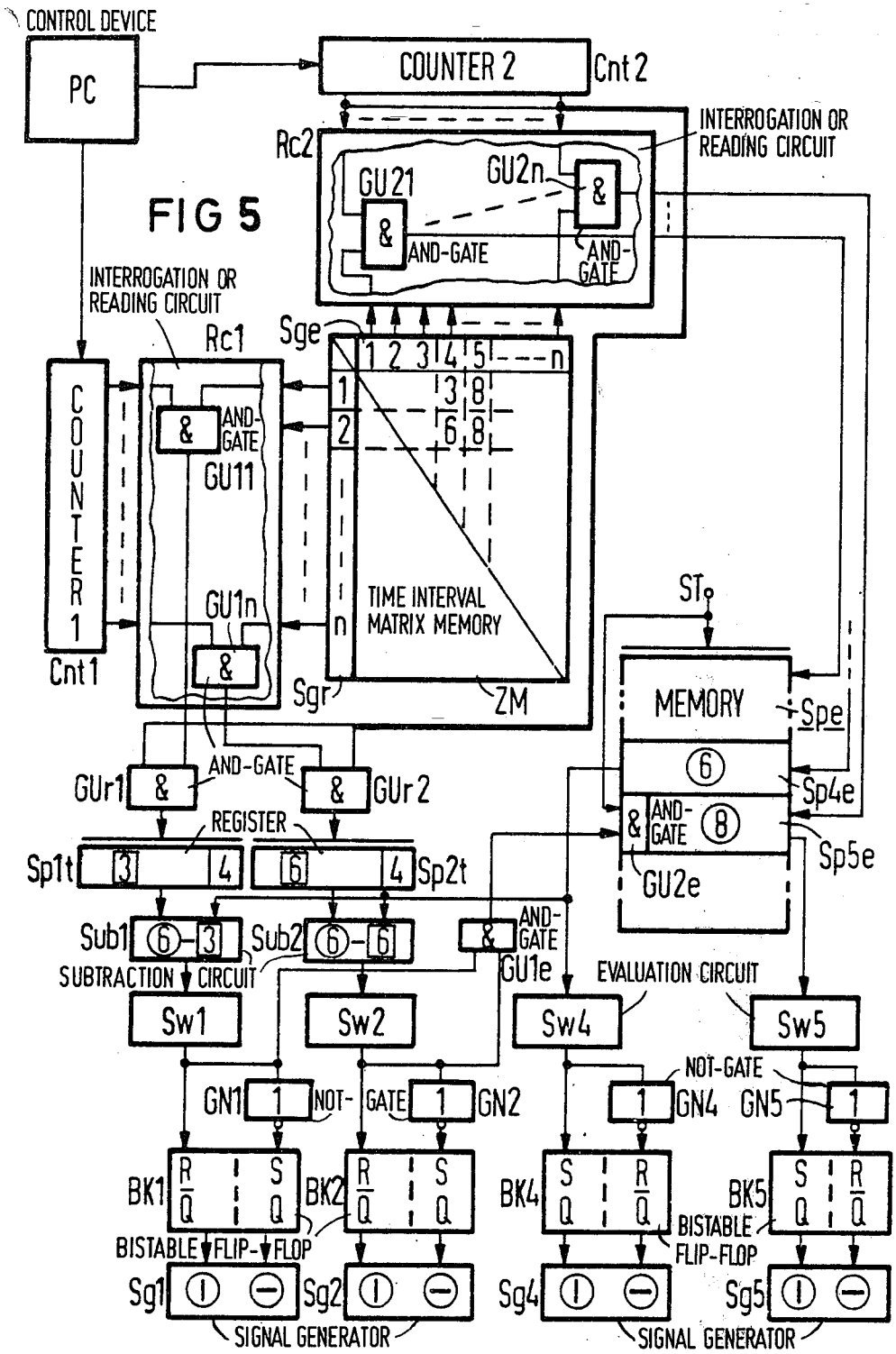
CONTROL DEVICE
PC
COUNTER 2
Cnt2
INTERROGATION OR READING CIRCUIT
Rc2
GU21
GU2n
AND-GATE
AND-GATE
FIG 5
INTERROGATION OR READING CIRCUIT
Rc1
Sge
COUNTER 1
Cnt1
AND-GATE
GU11
GU1n
TIME INTERVAL MATRIX MEMORY
Sgr
ZM
ST
MEMORY
Spe
Sp4e
Sp5e
GU2e
GUr1
GUr2
AND-GATE
REGISTER
Sp1t
Sp2t
Sub1
Sub2
SUBTRACTION CIRCUIT
AND-GATE
GU1e
EVALUATION CIRCUIT
Sw1
Sw2
Sw4
Sw5
NOT-GATE
GN1
GN2
GN4
GN5
BK1
BK2
BK4
BK5
BISTABLE FLIP-FLOP
Sg1
Sg2
Sg4
Sg5
SIGNAL GENERATOR
SIGNAL GENERATOR

METHOD AND CIRCUIT ARRANGEMENT FOR GENERATING SETTING SIGNALS FOR SIGNAL GENERATORS OF A TRAFFIC SIGNAL SYSTEM, PARTICULARLY A STREET TRAFFIC SIGNAL SYSTEM

BACKGROUND OF THE INVENTION

1. Field of the Invention

The present invention relates to a method and to a circuit arrangement for generating setting signals for signal generators of a traffic signal system, particularly of a street traffic signal system, upon employment of indications of time intervals between mutually hostile traffic flows contained in a time interval matrix.

2. Description of the Prior Art

A method and a device for securing the time intervals in street traffic signal systems is known in the art from German patent application P 27 39 616.3. In this known method and device, at the end of the green interval of each individual signal of the traffic flows to be automatically controlled, the time elapsing from that point on is summed in actual value memories. These actual value memories are compared to the reference value memories of the traffic flows which are hostile to the green signal and, when the prescribed values are achieved or, respectively, exceeded, the appertaining activation command is transmitted. Moreover, all reference value memory contents are summed in a further actual value memory at shorter intervals than corresponds to the time clock of the traffic signal system, the content of the further actual value memory being compared to the content of a reference value memory. Upon occurrence of an error, appropriate safety measures are triggered. Thereby, however, an activation command for activating a green signal is only given to the respective signal generator in response to a corresponding selection by a central control when it has been determined by means of a coincidence check that the respectively prescribed clearing time (i.e. the time intervals since the respective end of green) have terminated in all signal groups which are hostile to the group belonging to the respective signal generator. The control signals, for example the so-called red command, required for the activation of the respective signal generator given end of green, however, become directly effective from the central control transmitting such signals, i.e. immediately at the signal generator respectively coming into consideration. This, however, means that signal generators are already set to red in a disadvantageous manner which could per se have still remained set to green, at any rate with respect to the signal generators subsequently receiving green commands. Therefore, only a relatively poor exploitation of the clearing times actually available is achieved overall in the method heretofore known.

SUMMARY OF THE INVENTION

Accordingly, the object of the present invention is to provide a manner in which setting signals can be generated in a simpler manner than heretofore known for the optimum setting of signal generators of a traffic signal system and, particularly, of a street traffic signal system. In contrast to the methods heretofore known, red commands should only become effective at such times as the actual clearing times required.

The above object is achieved, according to the present invention, in a method of the type generally mentioned, in that, from the time interval matrix for each signal group, those entry time intervals which, with respect to those signal groups representing clearing signal groups, serve for the control of traffic flows which are hostile to the traffic flows controlled by the respective entry signal group are read and subsequently stored as an entry signal group granting a release setting signal to at least one traffic flow. Moreover, the greatest entry time interval for the respective entry signal group is separately stored and is reduced in value in cyclical succession until it reaches zero. The remaining entry time intervals stored for the same entry signal group are separately subtracted from the greatest entry time intervals stored for the respective entry signal group and reduced in value in cyclical succession. Upon occurrence of a zero difference between two such entry time intervals subtracted from one another, a blocking setting signal is emitted for that clearing signal group to which the one entry time interval employed in the appertaining differential formation relates. After the conclusion of the reduction of the originally greatest entry time interval to zero, a release setting signal is supplied to the appertaining entry signal group.

The invention provides the advantage that optimum setting signals for signal generators of a traffic signal system and, in particular, of a street traffic system, can be generated in a simple manner with respect to the actually existing clearing times. In particular, only the indications of time intervals between mutually hostile traffic flows contained in a time interval matrix are employed in order to generate the setting signals under consideration for the signal generators.

Advantageously, the greatest entry time interval for the respective entry signal group is reduced in value in the rhythm of one second. By doing so, the advantage arises that time values related to seconds can be contained in the time interval matrix, which leads to a particularly simple processing of the values contained in this time interval matrix.

For implementing the method of the present invention, it is advantageous to employ a circuit arrangement which is characterized in that there is connected to the time interval matrix an interrogation circuit which reads from the time interval matrix the time intervals of all entry signal groups with respect to the clearing signal groups hostile thereto and inputs the same into registers belonging to the respective entry signal group and inputs the greatest time interval of these intervals into a separate memory belonging to the entry signal group concerned. In the separate memory the time interval concerned can be reduced in value in successive control cycles to zero. Subtraction circuits follow the registers and the memory, the subtraction circuits forming the difference between the time interval value which is contained in the memory belonging to the respective entry signal group and the time intervals contained in the appertaining registers. The differential values formed with respect to each entry signal group and the time interval value respectively contained in the appertaining memory can be evaluated by evaluation circuits which, upon identification of a differential value of zero or, respectively, of a time interval value reduced to zero, respectively emit an output signal for the corresponding setting of the appertaining signal generator. By so doing, the advantage arises of a particularly low circuit expense for generating setting signals for signal generators of a traffic signal system and, in particular, of a street traffic signal system.

The interrogation circuit is preferably driven by counters, one of which characterizes entry signal groups with its counter readings and the other of which characterizes the clearing signal groups hostile to the respective entry signal group with its counter readings. Thereby, the counters can be adjusted by a control device. By doing so, the advantage arises of a particularly simple possibility of reading the time values contained in the time interval matrix for generating the setting signals.

With the assistance of the method of the present invention, it is therefore possible in a simple manner to generate optimum setting signals for signal generators of the traffic signal system, in particular a street traffic signal system, with respect to the actually existing clearing times. Thereby, in particular, only the indications of time intervals between mutually hostile traffic flows contained in a time interval matrix are employed in order to generate the setting signals coming into consideration for the signal generators. It has turned out, however, that it is sometimes advantageous to consider the entry time intervals of all entry signal groups hostile to one and the same clearing signal group for determining a change of signal. Therefore, for example, it often occurs that specific signal groups, particularly pedestrian signal groups which are to receive a release signal, namely a green signal, require the truncation of the sequencing phase of signal groups hostile thereto, in particular, vehicle signal groups, because of their great time intervals. With respect to vehicle signal groups in turn hostile to them, these signal groups per se could still keep green over a longer time interval.

In order to consider only desired entry time intervals for influencing a change of signal, the desired entry time intervals being among the entry time intervals hostile to one and the same clearing signal group read from the time interval matrix, it is provided, according to a further development of the invention, to first retain, of the entry time intervals read from the entry time interval matrix and separately stored and belonging to those entry signal groups which are hostile to one and the same clearing group, the time intervals of entry signal groups selected as non-determinant for influencing a signal change without alteration by means of a separate marking and to only make them effective for the reduction of their value in that case in which the non-marked entry time intervals of the entry signal groups hostile to the same clearing signal groups have elapsed and, after conclusion of the reduction of the respectively marked entry time interval to zero, to supply a release setting signal to the appertaining signal group concerned.

By so doing, the advantage is derived that, of the entry time intervals of entry signal groups hostile to one and the same clearing signal group respectively read from the time interval matrix and separately stored, only specific, desired entry time intervals can be taken into consideration in a relatively simple manner for the respective change of signal, whereas other, selected entry time intervals are not taken into consideration for influencing the respective change of signal. This, however, does not mean that the latter time intervals are completely left out of consideration; they are indeed taken into consideration with respect to their respectively appertaining entry signal group, but not for influencing the general change of signal between the mutually hostile signal groups.

Preferably, of the marked entry time intervals belonging to an entry signal group, only the greatest entry time interval is employed for generating a release setting signal for the appertaining signal group. This produces the advantage of a particularly simple manipulation of the marked entry time intervals.

Advantageously, the greatest entry time interval and the marked entry time interval which has respectively been made effective are reduced in value in the rhythm of one second. By so doing, the advantage arises that time values relating to seconds can be contained in the time interval matrix, which leads to a particularly simple processing of the values contained in the time interval matrix.

For implementing the method representing a further development of the invention, it is advantageous to employ a circuit arrangement in accordance with the circuit arrangement already specified above. Thereby, there is connected to the time interval matrix an interrogation circuit which reads the time intervals of all entry signal groups with respect to the clearing signal groups hostile thereto and inputs the same into registers belonging to the respective entry signal groups and inputs the greatest time interval of these time intervals into a separate memory belonging to the appertaining entry signal group. In the separate memory, the time interval concerned can be reduced in value in successive control cycles to zero. Following the registers and the memory are subtraction circuits which form the difference between the time interval contained in the memory belonging to the respective entry signal group and the time intervals contained in the appertaining registers. The differential values formed with respect to each entry signal group and the time interval value respectively contained in the appertaining memory can be evaluated by evaluation circuits which, upon identification of a differential value of zero or, respectively, of a time interval value reduced to zero, respectively emit an output signal (binary "1") for the corresponding setting of the appertaining signal generator. In accordance with the present invention, this circuit arrangement is characterized in that the time intervals of entry signal groups selected as being non-determinant for influencing a change of signal from the entry time intervals read from the time interval matrix are respectively input into a separate register as marked entry time intervals. The separate register receives, at its control input, control pulses for reducing its respectively stored time interval in value from a linkage arrangement only in that case in which the entry time intervals of those entry signal groups are reduced to zero which, together with the entry signal groups marked with respect to the entry time intervals, are hostile to the same clearing signal groups. An evaluation circuit is connected to the output of the separate register and emits an output signal (binary "1") for the corresponding setting of the appertaining signal generator only upon identification of a time interval value of the time interval stored in the appertaining separate register which has been reduced to zero. By so doing, there derives the advantage of a low circuit expense for generating setting signals for signal generators of a traffic signal system, in particular a street traffic signal system, whereby it is assured with a particularly low circuit expense that only the entry time intervals of respectively desired entry signal groups are taken into consideration in the direct influencing of the respective change of signal.

Advantageously, the linkage arrangement comprises a first AND gate and a second AND gate. The first AND gate emits a specific output signal at its output only given entry time intervals reduced to zero of those entry signal groups which, together with the entry signal groups marked with respect to the entry time intervals, are hostile to one and the same clearing signal group. The second AND gate is connected with one of its inputs to the output of the first AND gate and the second AND gate receives control pulses supplied at a further input. At its output, the second AND gate is connected to the control input of the separate register. By so doing, the advantage arises of a particularly low circuit expense with respect to supplying control pulses to the control input of the separate register in order to reduce its respectively stored time interval in value.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 2 is a schematic diagram of a circuit arrangement constructed in accordance with a first embodiment of the invention;

FIG. 5 is a schematic diagram of a circuit arrangement according to a second embodiment of the invention.

DESCRIPTION OF THE PREFERRED EMBODIMENTS

Figure 1:
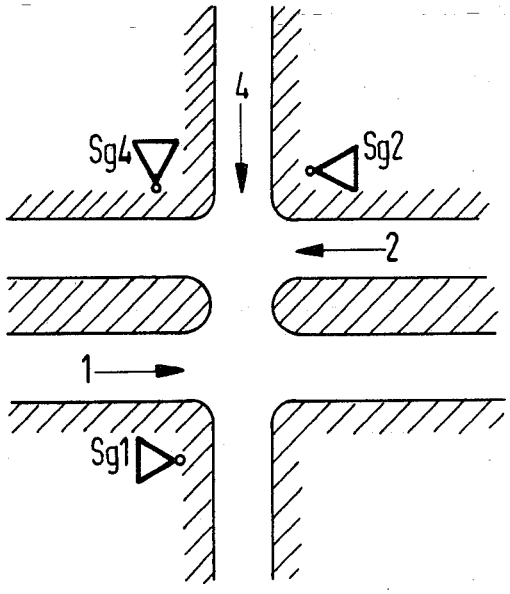
FIG. 1 is a diagrammatic representation of an intersection of a street traffic signal system specifically illustrating three traffic flows.

The intersection illustrated in FIG. 1 has four approaches with respect to which only three traffic flows 1, 2 and 4 are indicated. As can be seen, the two traffic flows 1 and 2 are hostile to the traffic flow 4. For releasing or, respectively, stopping the traffic flows 1, 2 and 4, individual signal generators Sg1, Sg2 and Sg4, belonging thereto. In the case of a street traffic intersection, the simplest case of a signal generator contains a green signal light and a red signal light.

FIG. 2 illustrates a circuit arrangement according to a first embodiment of the invention. This circuit arrangement allows the signal generators Sg1, Sg2 and Sg4 indicated in FIG. 1 to be controlled in a manner which will be explained in greater detail below. Among other things, the circuit arrangement comprises a time interval matrix memory ZM belonging, for example, only to the intersection illustrated in FIG. 1, which contains information concerning time intervals between mutually hostile traffic flows or, respectively, signal groups. To this end, so-called entry signal groups Sge are indicated in the uppermost line of the time interval matrix memory ZM, for example signal groups which release their appertaining traffic flows (i.e. contain green signals). In the outside left column of the time interval matrix memory ZM, so-called clearing signal groups Sgr are indicated, for example, such signal groups as block their appertaining signal flows (i.e. receive red signals). At the point of intersection of each column corresponding to an entry signal group Sge and a line associated with a clearing signal group Sgr respectively hostile thereto, information is stored in the time interval matrix memory ZM which indicates after which time the respective entry signal group can change to a green signal when the clearing signal group Sgr respectively hostile thereto has changed to a red signal. Referring to the numbers indicated in the time interval matrix memory ZM, this means that the entry signal group Sge referenced 4 can change to a green signal, for example, three seconds after the end of green of the clearing signal group Sgr referenced 1 and, for example, six seconds after the end of green of the clearing signal group Sgr referenced 2.

The time interval matrix ZM is connected to an interrogation circuit which essentially comprises two reading circuits Rc1 and Rc2. The reading circuits Rc1 and Rc2 are indicated as circuits containing AND gates GU11–GU1n and, respectively, GU21–GU2m, which circuits are connected with their one inputs to respectively one of two outputs of the time interval matrix ZM. Thereby, the interrogation circuit Rc1 is connected to the cells of the time interval matrix ZM characterized by the individual clearing signal group Sgr. The interrogation circuit Rc2 is connected with its one input side to the cells of the time interval matrix ZM characterized by the individual entry signal groups Sge.

Separate counters Cnt1 and Cnt2, adjustable by means of a control device PC, are provided for the interrogation circuits Rc1 and Rc2. Due to the respective counter reading, the counter Cnt1 determines the clearing signal group Sgr in respect of which information are to be read from the time interval matrix ZM by the interrogation circuit Rc1. Thereby, the arrangement can be undertaken in such a manner that all information inscribed in the time interval matrix ZM referring to a clearing signal group Sgr are respectively read from the matrix by the interrogation circuit Rc1 and that the signals or, respectively, data gained in such manner are linked to the counter reading of the counter Cnt2 in separate AND gates GUr1 and GUr2. By so doing, a clear assignment of the data of the respective signal group representing the time intervals to the entry signal group Sge hostile thereto is guaranteed.

It is further determined by the respective counter reading of the counter Cnt2 with respect to which entry signal group Sge data are to be read from the time interval matrix ZM by the interrogation circuit Rc2. Thereby, the interrogation circuit Rc2 should be connected with those cells of the matrix that, with respect to each entry signal group Sge, it respectively reads only the greatest numerical value out of the time interval matrix ZM. In the case of the entry signal group Sge referenced 4, therefore, only the value 6 is read out of the time interval matrix ZM by the interrogation circuit RC2. This largest time interval value determinant for the respective entry signal group is emitted from the interrogation circuit Rc2 to a memory cell of a memory Spe, the memory cell individually belonging to the entry signal group concerned. In the case of the entry signal group referenced 4, the value 6 is input into a memory cell Sp4e of the memory Spe. The appertaining memory Spe can, to this end, be directly connected with its memory cells to appropriate outputs of the interrogation circuit Rc2. An input ST receives control pulses in a fixed cycle of, for example, one second, in response to whose occurrence the content of every memory cell of the memory Spe is reduced by a specific value, for example by one. This shall be discussed below.

Registers Sp1t and Sp2t are connected on their input sides to the outputs of the AND gates GUr1 and GUr2 discussed above. These registers Sp1t and Sp2t are permanently assigned to the entry signal group referenced 4. This is also indicated by means of a 4 in the right-hand part of the respective register Sp1t and Sp2t. The time intervals representing the clearing times are inscribed in these two registers, the time intervals belonging in the time interval matrix ZM to the clearing signal groups Sgr referenced 1 and, respectively, 2 with respect to the entry signal group Sge referenced 4. Accordingly, the value 3 is written into the register Sp1t and the value 6 is entered into the register Sp2t, as indicated towards the left-hand side of the registers.

The subtraction circuits Sub1 and Sub2 are connected with their respective one inputs to the outputs of the registers Sp1t and Sp2t. The subtraction circuits Sub1 and Sub2 are connected in common with their respective other inputs to the output of one of the memory cells of the memory Spe. That memory cell belongs to the entry signal group to which the registers Sp1t and Sp2t connected to the subtraction circuits Sub1 and Sub2 also belong. In these subtraction circuits Sub1 and Sub2 there occurs a difference formation between the time indication 6 (contained in a circle) in the memory cell Sp4e of the memory Spe and the time indication 3 or 6 (contained in squares) in the respective registers Sp1t and Sp2t.

A respective evaluation circuit Sw1 and Sw2 are provided at the output side of the subtraction circuits Sub1 and Sub2 and an additional evaluation circuit Sw4 is connected to the output of the memory cell Sp4e of the memory Spe. These evaluation circuits can be constructed as threshold circuits which can be assumed to emit a binary signal "1" at their outputs when an input signal is supplied thereto which is characteristic of a differential value of zero between two numbers subtracted from one another or, respectively, for a time indication reduced to zero. The evaluation circuits can be formed by operational amplifiers being connected with one of its inputs to a reference voltage source. Thereby, let the evaluation circuits concerned also emit a corresponding binary signal "1" at their outputs when the differential signal supplied thereto is characteristic of a negative difference between the numbers subtracted from one another.

The signal generators Sg1, Sg2 and Sg4 already mentioned in conjunction with FIG. 1 belong to the evaluation circuits Sw1, Sw2 and Sw4. Thereby, the signal generator Sg1 is connected at its inputs to the outputs Q and $\overline{Q}$ of a bistable flip-flop BK1 which is connected to the output of the evaluation circuit Sw1, being directly controlled with a reset input R and indirectly by way of a NOT gate GN1 with a setting input S. In an analogous manner, the signal generator Sg2 is connected at its inputs to the outputs Q and $\overline{Q}$ of a bistable flip-flop BK2 which is connected to the output of the evaluation circuit Sw2, being connected directly with a reset input R and by way of a NOT gate GN2 with a setting input S. Finally, the signal generator Sg4 is connected in a like manner at its inputs to the outputs Q and $\overline{Q}$ of a bistable flip-flop BK4 which is connected to the output of the evaluation circuit Sw4. The flip-flop BK4 has its reset input R directly connected, while its setting input S is indirectly connected by way of a NOT gate GN4. The circles with a horizontal line entered in the signal generators Sg1, Sg2 and Sg4 of FIG. 2 are meant to indicate the respective green signal light, while a circle with a vertical line therethrough is meant to indicate the red signal light in the respective signal generators.

Since the format of the circuit arrangement illustrated in FIG. 2 has been explained above, the manner of operation of the circuit arrangement will now be discussed. This discussion will include reference to FIG. 3 for a particular illustration using the example set forth above. Therefore, the control operations to be carried out for the individual signal generators Sg1, Sg2 and Sg4 according to FIGS. 1 and 2 are illustrated in accordance with FIG. 3. A red signal phase is respectively indicated by means of the thick lines and a green signal phase is respectively indicated by means of the thin lines in FIG. 3. An end of green is respectively indicated by a circle and an end of red is indicated by means of a short vertical line. In the illustration concerned, the transition times red/yellow or, respectively, yellow are not taken into consideration since these do not seem to be essential for understanding the present invention.

As already mentioned above in conjunction with the circuit arrangement illustrated in FIG. 2, time data are read from the time interval matrix ZM by the interrogation circuits Rc1 and Rc2 and are input into the registers respectively coming into consideration, such as the registers Sp1t and Sp2t and into a memory cell or, respectively, a memory section, such as the cell Sp4e of the memory Spe. Subsequently thereto, a differential formation between the corresponding time data respectively occurs in the subtraction circuits Sub1 and Sub2. Before entering into greater detail concerning the operations related thereto, let it also be pointed out that the two bistable flip-flops BK1 and BK2 may first be assumed as being set, so that the two signal generators Sg1 and Sg2 illuminate their green signal lights. Further, let it be assumed that, first, the bistable flip-flop BK4 is reset, so that the red signal light of the signal generator Sg4 is illuminated.

Of the two subtraction circuits mentioned above, the subtraction circuit Sub2 immediately identifies the existence of a zero difference between the numerical values subtracted from one another. Subsequent thereto, the evaluation circuit Sw2 emits a binary signal "1" at its output upon whose occurrence the bistable flip-flop BK2 is reset. As a consequence, the green signal light of the signal generator Sg2 is extinguished and, instead, the red signal light of the signal generator Sg2 is lit. This point in time corresponds to the time t0 in FIG. 3. Since, as already mentioned above, the numbers or, respectively, time values, stored in the memory cells of the memory Spe are reduced in cyclical succession, for example in the rhythmic interval of one second, the subtraction circuit Sub1 will form a diminishing difference in cyclical succession between the time values it subtracts from one another. If the reduction of the value of the time stored in the memory cells of the memory Spe occurs in the rhythm of one second by a respective value of one, then, three seconds after the time t0, the subtraction circuit Sub1 will likewise identify the existence of a zero difference between the time values it has subtracted from one another. In response thereto, the evaluation circuit Sw1 emits a binary signal "1", which leads to the resetting of the bistable flip-flop BK1. As a consequence, the green signal light of the signal generator Sg1 is extinguished and the red signal light of the signal generator Sg1 is illuminated. This point in time corresponds to the time t3 in FIG. 3.

If the time value stored in the respective memory cell, such as the memory cell Sp4e of the memory Spe is reduced to zero, which will be the case for the memory cell Sp4e after six seconds, then the evaluation circuit Sw4 connected to the memory cell will emit a binary signal "1" at its output at this point in time. In response to the occurrence of this binary signal "1", the bistable flip-flop BK4 is set, whereby the illuminated red signal light of the signal generator Sg4 is extinguished and, instead, the green signal light is lit. This point in time corresponds to the time t6 of FIG. 3.

As already mentioned above, the two counters Cnt1 and Cnt2 of the circuit arrangement illustrated in FIG. 2 are connected to the output of a control device PC. The two counters receive their counter setting signals from the control device PC. The emission of these counter setting signals, thereby, will occur according to the measure of the signal plan to be sequenced overall, with respect to which the required time intervals between the individual mutually hostile signal groups are contained in the time interval matrix ZM. Accordingly, therefore, the control device PC need only set the two counters Cnt1 and Cnt2 at the points in time corresponding to the time t0 of FIG. 3. To this end, the control device PC can contain information concerning the required counter settings (i.e. the counter setting signals) in a time plan which is fixed accordingly. In this case, the appertaining control device PC will emit the corresponding data at the proper time. To this end, the control device PC, for example, can contain a clock pulse generator which emits clock pulses fixed according to a time plan to the counters Cnt1 and Cnt2 in order to set the counters.

Figure 3:
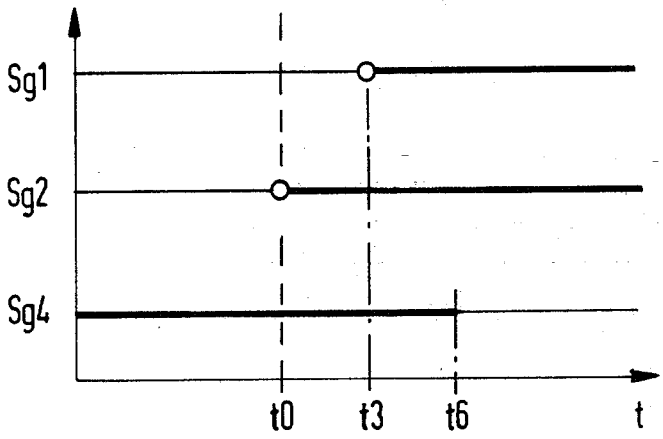
FIG. 3 is a timing chart illustrating a simplified signal cycle as derives from the intersection illustrated in FIG. 1 upon operation of the circuit arrangement illustrated in FIG. 2.

From the signal sequence according to FIG. 3, therefore, one can see that only the signal generator Sg2 receives an end of green signal at the time t0, so that it lights its red signal light beginning with the point in time t0. At this time, the signal generators Sg1 is still lighting its green signal light, whereas the signal generator Sg4 is still lighting its red signal light. At the time t3, which may be assumed to lie three seconds after the time t0, the signal generator Sg1 also receives an end of green signal, whereupon the signal generator Sg1 lights its red signal light. The signal generator Sg4 continues to light its red signal light. Only after the time t6, which may be assumed to lie six seconds after the time t0, does the signal generator Sg4 receive an end of red signal, whereupon the signal generator Sg4 lights its green signal light. Referring to the conditions indicated in FIG. 1, it thus derives that, of the traffic flows 1 and 2 hostile to the traffic flow 4, the traffic flow 2 is stopped first and the traffic flow 1 is stopped subsequent thereto. Therefore, the traffic flow 2 has a longer clearing time available than the traffic flow 1 with reference to the release of the traffic flow 4. Such a differing stoppage of the traffic flows 1 and 2 with respect to the release of the traffic flow 4 can therefore do justice in an optimum manner to conditions actually existing.

Figure 4:
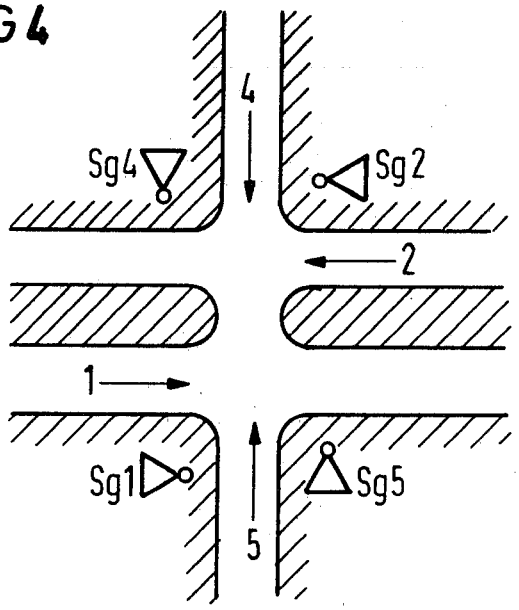
FIG. 4 is a diagrammatic representation of an intersection in a street traffic signal system for elucidation of a second embodiment of the invention and specifically illustrating four traffic flows.

The intersection illustrated in FIG. 4 exhibits four approaches, with respect to which only four traffic flows 1, 2, 4 and 5 are indicated. As can be seen, the two traffic flows 1 and 2 are hostile to the two traffic flows 4 and 5. For the release or, respectively, stoppage of the traffic flows 1, 2, 4 and 5 of FIG. 4, individual signal generators Sg1, Sg2, Sg4 and Sg5, are respectively assigned thereto. In the case of a street traffic intersection, let the signal generators respectively contain green and red signal lights as mentioned above for the simplest case.

A circuit arrangement according to a second embodiment of the invention is illustrated in FIG. 5. This circuit arrangement, which essentially coincides with the circuit arrangement of FIG. 2, allows the signal generators Sg1, Sg2, Sg4 and Sg5 indicated in FIG. 4 to be controlled in a manner to be described in greater detail below. The appertaining circuit arrangement comprises, among other things, a time interval matrix CM belonging, for example, only to the intersection illustrated in FIG. 4 which contains information concerning time intervals between mutually hostile traffic flows or, respectively, signal groups. To this end, so-called entry signal groups Sge are indicated in the uppermost line of the time interval matrix ZM, for example, signal groups which release their appertaining traffic flows (i.e. receive green signals). In the left-hand, outer column of the time interval matrix ZM, so-called clearing signal groups Sgr are listed, for example signal groups which block their appertaining traffic flows (i.e. receive red signals). At the point of intersection of each column corresponding to an entry signal group Sge and a line associated with a clearing signal group Sgr respectively hostile thereto, an indication is contained in the time interval matrix ZM indicating after what time the respective entry signal group can changed to a green signal when the clearing signal group Sgr hostile thereto has changed to a red signal. With reference to the numbers entered in the time interval matrix ZM, this means that the entry signal group Sge referenced 4 can receive a green signal at a point in time which, for example, lies three seconds after the end of green of the clearing signal group Sgr referenced 1 and which, for example, lies six seconds after the end of green of the clearing signal group Sgr referenced 2. In contrast thereto, the entry signal group Sge referenced 5 is to obtain a green signal at a point in time which lies eight seconds after the end of green of the two clearing signal groups Sgr1 and Sgr2.

The time interval matrix ZM is connected to an interrogation circuit which essentially comprises two reading circuits Rc1 and Rc2. These reading circuits Rc1 and Rc2 are indicated as circuits containing AND gates GU11–GU1n and, respectively, GU21–GU2n, these circuits being connected with one of their inputs to one of two outputs of the time interval matrix ZM. Thereby, the interrogation circuit Rc1 is connected to the cells of the time interval matrix ZM, the cells being characterized by the individual clearing signal groups Sgr. With its one input, the interrogation circuit Rc2, is connected to the cells of the time interval matrix ZM, the cells being characterized by the individual entry signal group Sge.

A separate counter Cnt1 or, respectively, Cnt2 adjustable by a control device PC respectively belongs to the two interrogation circuits Rc1 and Rc2. With its respective counter reading, the counter Cnt1 determines the clearing signal group Sgr in respect of which data are to be read from the time interval matrix ZM by means of the interrogation circuit Rc1. Thereby, the arrangement can be undertaken in such a manner that all data referring to a clearing signal group Sgr entered in the time interval matrix ZM are respectively read from the matrix by means of the interrogation circuit Rc1 and that signals or, respectively, data gained in that manner are linked to the counter reading of the counter Cnt2 in separate AND gates GUr1 and GUr2. By so doing, a clear assignment of those data of the respective clearing signal group representing the time intervals guaranteed to the entry signal group Sge hostile thereto.

Further, the respective counter reading of the counter Cnt2 determines in respect of which entry signal group Sge data are to be read from the time interval matrix ZM by means of the interrogation circuit Rc2. Thereby, the interrogation circuit Rc2 should be designed in such a manner that it respectively only reads the greatest numerical value out of the time interval matrix ZM with respect to each entry signal group Sge. In the case of the entry signal group Sge referenced 4, therefore, only the value 6 is read from the time interval matrix ZM by means of the interrogation circuit Rc2. With respect to the entry signal group 5, which may be a pedestrian signal group, the value 8 is read from the time interval matrix ZM by means of the interrogation circuit Rc2. These time interval values determinant for the respective entry signal group are emitted from the interrogation circuit Rc2 to a memory or, respectively, register cell of a memory Spe individually assigned to the respective entry signal group. In the case of the entry signal group Sge4, the value 6 is input into a memory or, respectively, register cell Sp4e of the memory Spe. In the case of the entry signal group Sge5, the value 8 is input into a separate register cell Sp5e of the memory Spe. To this end, the appertaining memory Spe can be directly connected with its memory cells to appropriate outputs of the interrogation circuit Rc2. Control pulses are supplied to the memory Spe at an input St in a fixed cycle of, for example, one second, in response to the occurrence of which the content of those memory cells of the memory Spe connected to the appertaining input ST are reduced by a specific value, for example by one. In the present case, this is true of the memory or, respectively, register cell Sp4e, not, however, for the memory or, respectively, the register cell Sp5e. The latter register cell receives corresponding pulses supplied by way of an AND gate GU2e which will be discussed below.

The registers Sp1t and, respectively, Sp2t are connected at their inputs to the outputs of the AND gates GUr1 and GUr2, already considered above. The registers Sp1t and Sp2t are permanently assigned to the entry signal group referenced 4. This is indicated by a 4 in the right-hand part of the respective register Sp1t and Sp2t, respectively. The time intervals representing the clearing times are entered into these two registers, the time intervals belonging to the clearing signal groups Sgr referenced 1 or, respectively, 2 in the time interval matrix ZM with respect to the entry signal group Sge referenced 4. Accordingly, the value 3 is entered in the register Sp1t and the value 6 is entered in the register Sp2t, as indicated towards the left-hand sides of these registers.

Subtraction circuits Sub1 and, respectively, Sub2 are connected with one of their inputs to the outputs of the two latter registers. Therefore, a subtraction circuit Sub1 is connected with its one input side to the output side of the register Sp1t. A subtraction circuit Sub2 is connected with its one input side to the output side of the register Sp2t. With their respective other inputs, the subtraction circuits Sub1 and Sub2 are connected in common to the output of one of the memory cells (here Sp4e) of the memory Spe. That memory cell assigned to the entry signal group to which the registers Sp1t and Sp2t, connected to the subtraction circuits Sub1 and Sub2, respectively, also belong. In these subtraction circuits Sub1 and Sub2 there occurs a difference formation between the time data (6 enclosed in a circle) contained in the memory cell Sp4e of the memory Spe and the time data (time data 3 or, respectively, 6 surrounded by a square) contained in the registers Sp1t or, respectively, Sp2t.

A respective evaluation circuit Sw1, Sw2 and Sw4 is connected to a respective output of the subtraction circuits Sub1 and Sub2 and to the output of the memory cell Sp4e of the memory Spe. These evaluation circuits may be a matter of threshold circuits which emit a binary signal "1" at their outputs when an input signal is supplied thereto which is characteristic of a differential value of zero between two numbers subtracted from one another or, respectively, for a time indication reduced to zero. Thereby, it is assumed that the appertaining evaluation circuits also emit a corresponding binary signal "1" at their outputs when the difference signal supplied thereto is characteristic of a negative difference between the numbers subtracted from one another.

Signal generators Sg1, Sg2 and Sg4 already mentioned in conjunction with FIG. 4 are assigned to the evaluation circuits Sw1, Sw2 and Sw4. Thereby, the signal generator Sg1 is connected at its inputs to the terminals Q, $\overline{Q}$ of a bistable flip-flop BK1 which is connected to the output of the evaluation circuit Sw1, the same being directly connected at a reset input R and by way of a NOT gate GN1 to a setting input S. In a corresponding manner, the signal generator Sg2 is connected on its input side to the outputs Q, $\overline{Q}$ of a bistable flip-flop BK2 which is connected to the output of the evaluation circuit Sw2, the connection being effected directly to a reset input R and indirectly by way of a NOT gate GN2 to a setting input S. Finally, the signal generator Sg4 is connected in an analogous manner at its input side to the outputs Q, $\overline{Q}$ of a bistable flip-flop BK4, which is in turn connected to the output of the evaluation circuit Sw4, the connection being effected directly to the setting input S and by way of a NOT gate GN4 to its reset input R. Circles provided with a horizontal line entered in the signal generators Sg1, Sg2, Sg4 and Sg5 as shown in FIG. 5 are meant to indicate, as set forth above, the respective green signal light, while the circle with a vertical line is meant to indicate a red signal light in the respective signal generator.

In addition to the circuit elements described above, the circuit arrangement illustrated in FIG. 5 also comprises among other things, an AND gate GU1e which, together with the AND gate GU2e already discussed above, forms a linkage arrangement. The AND gate GU1e is connected at its inputs to the outputs of the two evaluation circuits Sw1 and Sw2 and includes an output which is connected to an input of the AND gate GU2e. The AND gate GU2e is connected by way of a further input to the control input ST to which control pulses are supplied. The AND gate GU2e emits the control pulses supplied thereto from the circuit point ST, emitting the same at its output in the case when it is transmissive. These control pulses emitted from the output of the AND gate GU2e serve to successively reduce the content of the register cell Sp5e in value. An evaluation circuit Sw5, which may be designed in a corresponding manner as the remaining evaluation circuits Sw1, Sw2 and Sw4 discussed previously, is connected to the output of the register cell Sp5e of the memory Spe. A further bistable flip-flop BK5 is connected to the output of the evaluation circuit Sw5, being connected directly to the setting input S and indirectly by way of a NOT gate GN5 with a reset input R. The signal generator Sg5 is connected to the outputs Q, $\overline{Q}$ of the bistable flip-flop BK5.

In the following, the manner of operation of the circuit arrangement illustrated in FIG. 5 is discussed in greater detail. Thereby, the signal sequence illustrated in FIG. 6 shall also be discussed, by means of which the manner of operation of the appertaining circuit arrangement can be particularly well set forth. In accordance with FIG. 6, the control operations to be executed for the individual signal generators Sg1, Sg2, Sg4 and Sg5 according to FIGS. 4 and 5 are illustrated. A red signal phase is respectively indicated by a thick line, and a green signal phase is respectively indicated by the thin lines. An end of green is respectively indicated by a circle and an end of red is indicated by a short vertical line. In the appertaining illustration, the transition times red/yellow or, respectively, yellow are not taken into consideration since these are not essential for understanding the present invention.

As already explained in conjunction with the circuit arrangement illustrated in FIG. 5, time data are read from the time interval matrix ZM by the interrogation circuits Rc1 and Rc2 and are written into the registers respectively coming into consideration, such as the registers Sp1t and Sp2t, and into the appertaining memory or, respectively, register cells, such as the elements Sp4e and Sp5e of the memory Spe. Subsequent thereto, there occurs in the subtraction circuits Sub1 and Sub2 a respective difference formation between the time data inscribed in the registers Sp1t and Sp2t. The operations connected therewith need not be discussed in greater detail herein, since these operations have already been explained in detail with respect to FIGS. 1–3.

Differing from the circuit arrangement illustrated in FIG. 2, in the present circuit arrangement the time intervals of all entry signal groups which are hostile to one and the same clearing signal group are not taken into consideration for influencing or, respectively, determining a change of signal. On the contrary, in the present case the time intervals of selected entry signal groups are therefore left out of consideration, in that the appertaining time intervals are separately marked. Given the conditions indicated in FIG. 5, the entry time interval of the entry signal group Sge5 is such a marked time interval. This time interval 8 has been read from the time interval matrix ZM into the register Sp5e. In this separate register, the time interval 8 is retained without change as, so to speak, a marked time interval until the entry time intervals 3 or, respectively, 6 of the entry signal group Sge4 have elapsed, these being just as hostile with respect to the clearing signal groups Sgr1 and Sgr2 as the entry signal group Sge5. Only when these time intervals of the entry signal group Sge4 have elapsed with respect to the clearing signal groups Sgr1 and Sgr2, does the AND gate GU1e provided in the circuit arrangement according to FIG. 5 emit a specific output signal (binary signal "1") at its output, upon whose occurrence the control pulses arising at the circuit point ST arrive by way of the AND gate GU2e and thus reduce the content of the register Sp5e of the memory Spe in value.

When the content or, respectively, time interval value of the register Sp5e has been reduced to zero, the evaluation circuit Sw5 emits a binary signal "1" at its output, by means of which binary signal "1" the bistable flip-flop BK5 is set, so that, therefore, the signal generator Sg5 lights its green signal light. Thereby, it is presumed that the signal generator Sg5, as well as the signal generator Sg4, are first reset so that the red signal lights of these signal generators are first lit.

It should also be pointed out with respect to the entry signal group Sge5 indicated in the time interval matrix ZM according to FIG. 5, as already explained above, that only one time indication 8 has been deposited in the separate register Sp5e with respect to the entry signal group Sge5. This time indication, in general, is a matter of the greatest time indication or, respectively, time interval which is contained in the time interval matrix ZM concerning such an entry signal group with respect to all clearing signal groups hostile thereto.

Figure 6:
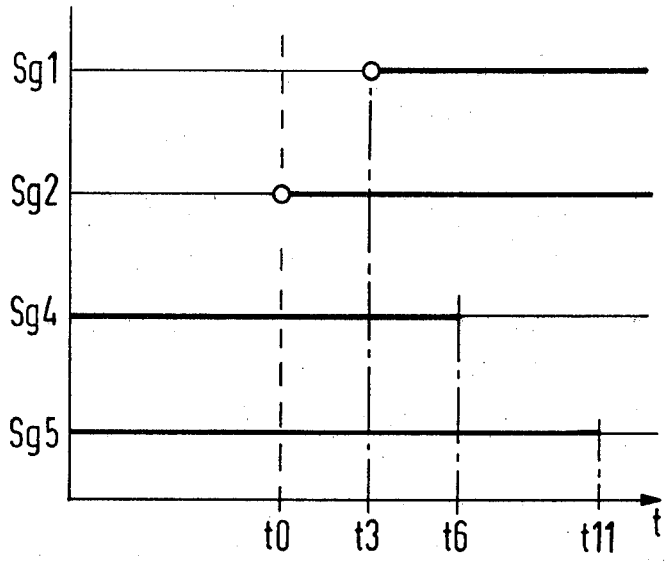
FIG. 6 is a timing chart illustrating a simplified signal cycle as derives for the intersection illustrated in FIG. 4 upon operation of the circuit arrangement illustrated in FIG. 5.

In order to emphasize the import of the present embodiment in contrast to the method employed in FIG. 2 and in contrast to the circuit arrangement illustrated in FIG. 2, the circuit arrangement of the present embodiment will be discussed in detail with reference to FIG. 6. One can see from the signal sequence illustrated in FIG. 6 that only the signal generator Sg2 receives an end of green signal at a time t0, so that it lights up its red signal light beginning at the time t0. At this time, the signal generator Sg1 is still illuminating its green signal light, whereas the signal generators Sg4 and Sg5 are still lighting their red signal lights. At the time t3, which may be assumed to be three seconds after the time t0, the signal generator Sg1 also receives an end of green signal, whereupon the signal generator Sg1 lights its red signal light. The signal generators Sg4 and Sg5 continue to light their red signal lights. Only at the time t6, which may be assumed to be six seconds after the time t0, does the signal generator Sg4 light its green signal light. Referring to the traffic conditions illustrated in FIG. 4, it therefore also follows in the present case, as in the manner of operation explained with respect to FIG. 2, that, of the traffic flows 1 and 2 hostile to the traffic flow 4, the traffic flow 2 is stopped first and the traffic flow 1 is also stopped subsequent thereto. Thereby, the signal generator Sg5, as may well have become apparent, has not influenced the change of signal discussed. The signal generator Sg5 continues to light its red signal light until the time t11. The time t11 is eight seconds after the time t3, i.e. that point in time after which the AND gate GU1e in the circuits arrangement according to FIG. 5 emits a binary signal "1" at its output. Beginning with the time t3, the time interval data 8 contained in the register Sp5e is reduced step-by-step to zero. Since, in the present case, this occurs in the rhythm of a second, the signal generator Sg5 does not light its green signal light until eight seconds after the time t3, i.e. at the time t11. Due to the differing stoppage of the traffic flows 1 and 2 with respect to the (initiation) release of the traffic flows 4 and 5, therefore, justice can be done in an optimum manner to the conditions actually existing, whereby, at the same time, the time intervals of the entry signal groups to be taken into consideration can be selectively designed for determining or, respectively, influencing the respective change of signal. In other words, this means that, in an analogous manner, the time intervals of selected entry signal groups can thereby be selectively left out of consideration. The time interval 8 of the entry signal group 5 indicated in the time interval matrix ZM according to FIG. 5 is such a time interval which has been left out of consideration. It should also be pointed out with respect to the entry signal group 5, that its entry time interval of eight seconds in the present case is observed only with reference to the hostile clearing signal group Sg1, whereas a longer time interval exists with respect to the hostile signal group Sg2 then is required by the time interval matrix ZM. However, that is accepted in the present case since, by means of the manner of operation described, it is assured that the entry signal group Sg5, because of its relatively long time interval, cannot request the premature termination of the clearing signal group Sgr1 and Sgr2 hostile thereto in that case in which these clearing signal groups still have a respective green signal.

In order to illustrate these latter operations, the case will be briefly considered in which the entry signal group Sge5 is taken into consideration in such a manner as has been explained with respect to FIG. 2, deviating from the conditions described above and provided according to the present invention. In this case, the time interval of the eight seconds would be the greatest entry time interval which would then be processed together with remaining time intervals of the time interval matrix in the manner described above with respect to FIG. 2. The result of this would be that the two traffic flows 1 and 2 would be immediately arrested and the traffic flows 4 and 5 would be released eight seconds later. Such a control of the traffic flow, however, can at times be undesirable as has already been explained above. Accordingly, in the present embodiment, the time intervals of specific, selected entry signal groups are marked in the manner described above. Deviating from the conditions discussed, this marking can also occur in such a manner that appropriate marking information are incorporated in the time interval matrix, the marking information effecting the appropriate treatment of the appertaining time intervals when the same are read.

It should be also pointed out, concerning the circuit arrangement in FIG. 5, that the two counters Cnt1 and Cnt2 of the appertaining circuit arrangement receive counter setting signals supplied from the control device PC. Thereby, the outputs of these counter setting signals will occur according to the measure of the signal plan to be sequenced overall, with respect to which the required time intervals between the individual, mutually hostile signal groups are contained in the time interval matrix ZM. Therefore, the control device PC need set the two counters Cnt1 and Cnt2 only at times corresponding to the time t0 according to FIG. 6. To this end, the control device PC can contain data concerning the required counter settings (i.e. the appropriate counter setting signals) in a time plan fixed accordingly. In this case, the control device PC will emit the corresponding data at the proper time. Thereby, one can proceed in such a manner that all data of the time interval matrix ZM are respectively read in the cyclic rhythm of one second, as is also the case in the circuit arrangement according to FIG. 2. The control device PC, therefore, will be expediently designed exactly like the control device PC according to FIG. 2, i.e. with a clock pulse generator which emits clock pulses fixed according to a time schedule.

It should also be pointed out that the circuit arrangements explained in conjunction with FIGS. 2 and 5 can be realized not only in discrete circuit technology but, rather, that the circuits arrangements can also be constructed upon employment of a respective microcomputer system employing at least one microprocessor.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A method for generating setting signals for operating traffic signal generators which control mutually hostile traffic flows, comprising the steps of:

storing in a matrix memory time intervals corresponding to entry signal groups representing release of traffic flow by respective traffic signal generators and associated to hostile clearing signal groups representing stoppage of traffic flow by respective traffic signal generators;

reading the time intervals corresponding to a distinct entry signal group and associated to clearing signal groups hostile to said entry signal group from the matrix memory;

storing the greatest time interval of said time intervals read from the matrix memory in a separate storage element and cyclically reducing said stored time interval to zero;

subtracting each of said time intervals read from the matrix memory from said stored greatest time interval being cyclically reduced;

detecting a zero difference of the subtraction results and emitting a respective block signal for a signal generator of the appertaining clearing signal group to which the respective subtracted time interval is associated; and emitting a release signal to a signal generator of said distinct entry signal group upon detection of a zero value of said cyclically reduced greatest time interval.

2. The method of claim 1, wherein the step of cyclically reducing the stored greatest time interval is further defined as:

reducing the stored greatest time interval by one second at each cycle, the cycle having a rhythm of one second.

3. The method of claim 1, comprising the further steps of:

storing at least one of said time intervals corresponding to a distinct entry signal group representing selected information in a separate storage element;

cyclically reducing said time interval representing selected information to zero after at least one of said zero differences is detected; and emitting a release signal to release the traffic flow controlled by the appertaining signal generator when said time interval representing selected information has been reduced to zero.

4. The metod of claim 3, wherein the step of storing is further defined as:

storing the greatest time interval, of those time intervals representing selected information, for reduction to zero.

5. The method of claim 4, wherein each of the steps of cyclically reducing the time intervals is further defined as:

cyclically reducing by one second at each cycle, the cycle having a rhythm of one second.

6. A circuit arrangement for generating setting signals for operating traffic signal generators which control mutually hostile traffic flows, comprising:

a matrix memory storing time intervals corresponding to entry signal groups and associated to clearing signal groups;

interrogation means connected to said matrix memory for reading respectively the time intervals corresponding to one of the entry signal groups and associated to all clearing signal groups hostile thereto;

register means connected to said interrogation means for storing the read time intervals;

storage means connected to said interrogation means for separately storing the greatest time interval read from said matrix memory;

reduction means connected to said storage means for cyclically reducing the value of the greatest time interval read;

subtraction means connected to said register means and to said storage means for subtracting the time intervals stored in said register means from the greatest time interval being cyclically reduced to form respective difference values; and evaluation means connected to said subtraction means and to said signal generators for determining when each difference value reaches zero and responsive thereto to emit output signals for controlling the signal generators.

7. The circuit arrangement of claim 6, and further comprising:

a control device operable to produce control pulses;

and wherein said interrogation means comprises first and second interrogation circuits connected to said matrix memory for reading time intervals;

a first counter operated by said control device and connected to said first interrogation circuit and operable to sequentially control said interrogation circuit to read entry signal group information; and a second counter operated by said control device and connected to said second interrogation circuit and operable to sequentially control said second interrogation circuit to read clearing group information hostile to the respective entry signal group.

8. The circuit arrangement of claim 6, and further comprising:

a separate register including an information input connected to said interrogation means for receiving time interval information as selected information, and including an input connected to said reduction means for reducing cyclically the stored time interval information;

a logic circuit connected between said evaluation means and said input connected to said reduction means and operable to gate through said input in response to at least one of said evaluation means emitting an output signal associated to a zero difference; and additional evaluation means connected to said separate register and to an additional signal generator and operable in response to the selected information reaching zero to emit an output signal to control the respective signal generator.

9. The circuit arrangement of claim 8, wherein:

said evaluation means comprises a plurality of evaluation circuits each assigned to a respective traffic signal generator; and said logic circuit comprises a first AND gate having inputs connected to selected ones of said evaluation circuits, and an output, and a second AND gate having an output connected to said input of said separate register connected to said reduction means, a first input connected to said output of said first AND gate and a second input connected to said reduction means.

* * * * *